US007421236B2

(12) United States Patent
Jang et al.

(10) Patent No.: US 7,421,236 B2
(45) Date of Patent: Sep. 2, 2008

(54) FIXING UNIT INCLUDING BACKUP PRESSURE MEMBERS AND IMAGE FORMING APPARATUS HAVING THE SAME

(75) Inventors: Jae-hyeok Jang, Seoul (KR); Dong-kyun Kang, Suwon-si (KR); Seung-jun Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 94 days.

(21) Appl. No.: 11/483,588

(22) Filed: Jul. 11, 2006

(65) Prior Publication Data

US 2007/0025783 A1 Feb. 1, 2007

(30) Foreign Application Priority Data

Jul. 28, 2005 (KR) ..... 10-2005-0069121

(51) Int. Cl.
*G03G 15/20* (2006.01)

(52) U.S. Cl. ..... 399/328; 399/329

(58) Field of Classification Search ..... 399/331, 399/328, 329, 320; 219/216, 243; 347/156
See application file for complete search history.

(56) References Cited

U.S. PATENT DOCUMENTS

RE32,126 E * 4/1986 Sasaki ..... 100/158 R
4,799,085 A * 1/1989 Nagumo et al. ..... 355/405
4,827,284 A * 5/1989 Ogiwara ..... 346/25
4,965,623 A * 10/1990 Ogiwara et al. ..... 355/406
5,671,474 A * 9/1997 Fukano ..... 399/331
5,737,679 A * 4/1998 Uehara et al. ..... 399/329
6,226,487 B1 * 5/2001 Yamashita et al. ..... 399/307
2004/0240913 A1 * 12/2004 Tomatsu ..... 399/328
2005/0008411 A1 * 1/2005 Chung et al. ..... 399/328
2006/0257179 A1 * 11/2006 Kim et al. ..... 399/328 X
2007/0020003 A1 * 1/2007 Kang et al. ..... 399/328
2007/0025784 A1 * 2/2007 Ito et al. ..... 399/329

FOREIGN PATENT DOCUMENTS

JP 05-165361 A * 7/1993
JP 05-297759 11/1993
JP 09-044030 2/1997
JP 09-090791 4/1997
JP 09-171321 6/1997
JP 2000-089601 3/2000
JP 2002-123119 4/2002

* cited by examiner

*Primary Examiner*—Sophia S Chen
(74) *Attorney, Agent, or Firm*—Stanzione & Kim, LLP

(57) ABSTRACT

A fixing unit, and an image forming apparatus having the fixing unit. The fixing unit includes a heat roller including a heat source therein, one or more pressing rollers in close contact with the heat roller, an elastic body to elastically apply pressure on both ends of the one or more pressing rollers with respect to the heat roller, a backup member to contact a central portion of the one or more pressing rollers and to apply pressure to the central portion in a longitudinal direction of the one or more pressing rollers, and a backup elastic body to elastically press the backup member towards the heat roller.

23 Claims, 8 Drawing Sheets

FIXING UNIT INCLUDING BACKUP PRESSURE MEMBERS AND IMAGE FORMING APPARATUS HAVING THE SAME

CROSS-REFERENCE TO RELATED APPLICATIONS

This application claims priority under 35 U.S.C. §119(a) from Korean Patent Application No. 10-2005-0069121, filed on Jul. 28, 2005, in the Korean Intellectual Property Office, the disclosure of which is incorporated herein in its entirety by reference.

BACKGROUND OF THE INVENTION

1. Field of the Invention

The present general inventive concept relates to a fixing unit and an image forming apparatus having the fixing unit, and more particularly, to a fixing unit to form a uniform fixing nip to which heat and pressure are uniformly applied along a longitudinal direction thereof by preventing pressing rollers from having a bending deformation, and an image forming apparatus having the fixing unit.

2. Description of the Related Art

In image forming apparatuses, light is illuminated onto a uniformly charged photosensitive drum to form a predetermined latent image, the latent image formed on the photosensitive drum is developed into a visible image by supplying a toner thereto, and the developed image is transferred and fused onto a printing medium to be printed.

In a conventional fixing unit, two rollers closely contact each other, that is, a heat roller, which includes a heat source therein, and a pressing roller, which is closely positioned to come in contact with the heat roller by applying a predetermined pressure thereto, to form a fixing nip along a longitudinal direction thereof, and a toner image is fused onto a printing paper when the printing paper, on which the toner image is transferred, passes through the fixing nip. To obtain a fixing nip that is sufficient for a desired fixing quality, a size of a pressure area between the two rollers (i.e., the fixing nip) should be increased. If a diameter of the pressing roller is increased to this end, a size and weight of the fixing unit is also increased. As a result, an image forming apparatus having the fixing unit thus becomes large, and a material cost thereof thus rises. Accordingly, there are limits on increasing the diameter of the pressing roller. As an alternative method of increasing the size of the fixing nip, an elastic pressure of a spring that presses the pressing roller to the heat roller may be increased. In this case, however, the pressing roller may be bent and deformed due to the increased elastic pressure. As a result, the size of the fixing nip is decreased at a center portion of the pressing roller in a longitudinal direction thereof, and sufficient pressure cannot be applied at the center portion, which leads to a problem that toner particles cannot be sufficiently fused onto the printing paper.

In recent years, a fixing unit having a structure in which two pressing rollers having relatively smaller diameters contact the heat roller sequentially along an outer circumference of the heat roller has been developed. There have been merits in that the fixing unit is less limited in size or weight by providing small pressing rollers, and the size of the fixing nip can be sufficiently increased by providing a plurality of pressing rollers. However, the rigidity of the pressing rollers deteriorates as the sizes thereof are reduced, so the pressing rollers becomes severely bent and deformed.

FIG. 1 is a view illustrating a deformed pressing roller, and a state of bending in FIG. 1 is exaggerated for convenience.

Referring to FIG. 1, an elastic force F is applied at both ends of a pressing roller 10 to press the pressing roller 10 to closely contact a heat roller 30, and the pressing roller 10 is thereby bent and deformed. More specifically, the contact between the pressing roller 10 and the heat roller 30 gradually deteriorates from one end of the pressing roller 10 to a center portion thereof in a longitudinal direction of the pressing roller 10, and a curve portion C is formed on the center portion of the pressing roller 10. In this case, heat and pressure conditions become uneven in a width direction of the printing paper (corresponding to the longitudinal direction of the pressing roller 10), which leads to poor fixing, and thus sufficient heat and pressure required for fixing is not delivered to the curve portion C formed in the center portion of the pressing roller 10. For a reference, the bending deformation of the pressing roller 10 can be quantified into a vertical distance e that is measured from one end of the pressing roller 10 to the curve portion C in the center portion thereof in the longitudinal direction of the pressing roller 10. For example, the distance e can be approximately 0.117 mm. In addition to a resulting poor printing quality, excessive elastic force applied to end portions of the heat roller 30 and the pressing roller 10 reduces a lifespan of entire fixing units, including the heat roller 30.

SUMMARY OF THE INVENTION

The present general inventive concept provides a fixing unit to prevent a pressing roller from being deformed, so that a uniform fixing nip can be formed between a heat roller and the pressing roller, and an image forming apparatus having the fixing unit.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a fixing unit to thermally fuse a toner image onto a printing medium by applying heat and pressure to the printing medium having the toner image, the fixing unit including a heat roller including a heat source, one or more pressing rollers in contact with the heat roller, an elastic body to elastically apply pressure to both ends of the one or more pressing rollers towards the heat roller, one or more backup members in close contact with a central portion of a corresponding pressing roller to locally press the central portion of the pressing roller towards the heat roller, and one or more backup elastic bodies to elastically press a corresponding one of the backup members towards the heat roller.

The one or more pressing rollers may include a plurality of pressing rollers in close contact with the heat roller sequentially along an outer circumference of the heat roller.

The one or more backup members may have an arc shaped section to cover at least a portion of an outer circumferential surface of the corresponding pressing roller.

The one or more backup elastic bodies may be located along a line that connects an axis-core of the heat roller and an axis-core of the corresponding pressing roller to each other to provide an elastic force along the line towards the heat roller.

The one or more backup members may include a boss protruding from a first side of the one or more backup members opposite to a second side of the one or more backup members in contact with the corresponding pressing roller and in which the backup elastic body is fixedly inserted.

The one or more backup members may include a release layer in slide-contact with the corresponding pressing roller.

At least one end of the one or more backup members covering the corresponding pressing roller may be rounded.

The foregoing and/or other aspects and utilities of the present general inventive concept may also be achieved by providing an image forming apparatus having an image forming unit to transfer a toner image onto a printing medium and a fixing unit to thermally fix the transferred toner image onto the printing medium, the fixing unit including a heat roller including a heat source, one or more pressing rollers in close contact with the heat roller, an elastic body to elastically apply pressure to both ends of the one or more pressing rollers towards the heat roller, a backup member in close contact with a central portion of a corresponding one of the one or more pressing rollers to locally press the central portion thereof towards the heat roller, and a backup elastic body to elastically press a corresponding backup member towards the heat roller.

The foregoing and/or other aspects and utilities of the present general inventive concept may also be achieved by providing a pressure unit useable in a fixing device of an image forming apparatus, the pressure unit including at least one pressure roller to apply pressure to a printing sheet having an image to be fixed, a support unit to rotatably support the at least one pressure roller and to provide a first elastic force to the at least one pressure roller, and a pressure member corresponding to each pressure roller and extending along a longitudinal direction of the corresponding pressure roller and in contact therewith to provide a second elastic force to the corresponding pressure roller.

The support unit can provide the first elastic force to first and second ends of the at least one pressure roller, and the pressure member can provide the second elastic force to a center portion of the corresponding pressure roller. The support unit can include a first bushing to rotatably support a first end of the at least one pressure roller and is elastically biased towards the at least one pressure roller, a second bushing to rotatably support a second end of the at least one pressure roller and is elastically biased towards the at least one pressure roller, and a connecting member to connect the first and second bushings to each other. The support unit can be a monolithic structure. The support unit can include an elastic member to provide the first elastic force thereto, and the pressure member can include at least one elastic member to provide the second elastic force to the corresponding pressure roller. The at least one pressure roller can be a single pressure roller. The support unit can provide the first elastic force to the at least one pressure roller in a direction along a line extending from a center of the support unit through a center axis of the at least one pressure roller, and the pressure member can provide the second elastic force to the corresponding pressure roller in the direction.

The foregoing and/or other aspects and utilities of the present general inventive concept may also be achieved by providing a pressure unit useable in a fixing device of an image forming apparatus, the pressure unit including a first pressure roller to apply pressure to a printing sheet having an image to be fixed, a first pressure member extending along a longitudinal direction of the first pressure roller and in sliding contact with the first pressure roller to provide a first elastic force to the first pressure roller, a second pressure roller to apply pressure to the printing sheet, a second pressure member extending along a longitudinal direction of the second pressure roller and in sliding contact with the second pressure roller to provide a second elastic force to the second pressure roller, and a support unit to rotatably support both of the first and second pressure rollers and to provide a third elastic force to the first pressure roller and a fourth elastic force to the second pressure roller.

The third and fourth elastic forces can be equal. The support unit can provide the third and fourth elastic forces in a first direction along a first line extending from the supporting unit and between the first and second pressure rollers that is equidistant from the first and second pressure rollers, the first pressure member can provide the first elastic force in a second direction along a second line extending through a center axis of the first pressure roller and forming a first angle with the first line, and the second pressure member can provide the second elastic force in a third direction along a third line extending through a center axis of the second pressure roller and forming a second angle with the first line. The first and second angles can be equal.

The foregoing and/or other aspects and utilities of the present general inventive concept may also be achieved by providing a fixing unit useable in an image forming apparatus, including a heat roller to apply heat to a printing medium having an image thereon, and a pressure unit to apply pressure to the printing medium, the pressure unit including at least one pressure roller to apply pressure to a printing sheet having an image to be fixed, a support unit to rotatably support the at least one pressure roller and to provide an elastic force to the at least one pressure roller, and a pressure member extending along a longitudinal direction of a corresponding one of the at least one pressure roller and in sliding contact therewith to provide another elastic force to the corresponding pressure roller.

The at least one pressure roller can be a single pressure roller. The at least one pressure roller can include first and second pressure rollers, and the pressure unit can include a first pressure member extending along a longitudinal direction of the first pressure roller and in sliding contact therewith to provide a first elastic force to the first pressure roller, and a second pressure member extending along a longitudinal direction of the second pressure roller and in sliding contact therewith to provide a second elastic force to the second pressure roller, in which the support unit rotatably supports both of the first and second pressure rollers and to provide a third elastic force to the first pressure roller and a fourth elastic force to the second pressure roller.

The foregoing and/or other aspects and utilities of the present general inventive concept may also be achieved by providing a fixing unit useable in an image forming apparatus, including a belt to convey a printing medium containing an image through the fixing unit, a heating unit on a first side of the belt to provide heat to the printing medium to fix the image, and a pressure unit to press the belt toward the heating unit, the pressing unit including a first pressure roller to press a first portion of the belt towards a first portion of the heating roller to form a first fixing area between the first pressure roller and the heating roller, a first pressure member to provide a first elastic force to the first pressure roller towards the belt, a second pressure roller to press a second portion of the belt towards a second portion of the heating roller to form a second fixing area between the second pressure roller and the heating roller, a second pressure member to provide a second elastic force to the second pressure roller towards the heating roller, and a support unit to rotatably support the first and second pressure rollers and to provide third and fourth elastic forces to the first and second pressure rollers, respectively, towards the heating roller.

A length of the first fixing area can be substantially equal to a length of the second fixing area.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
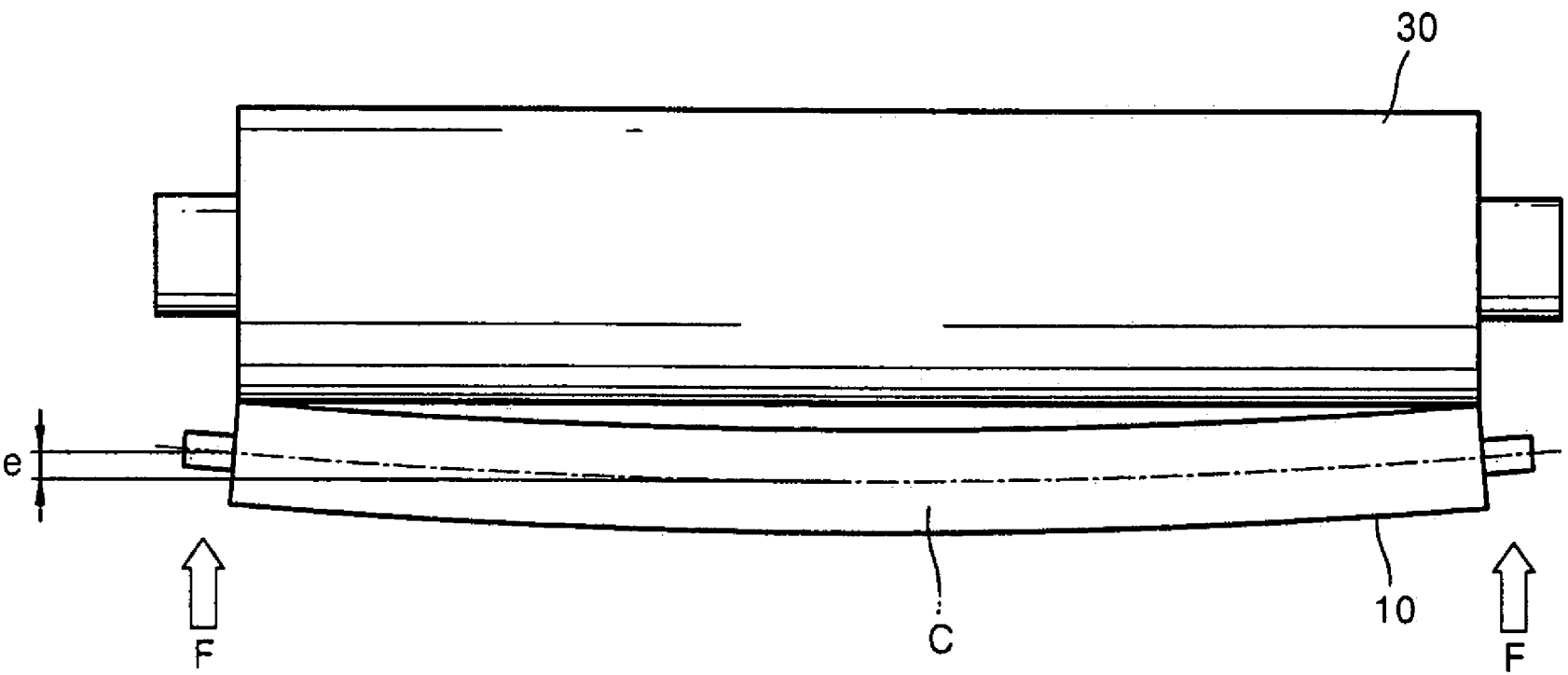
FIG. 1 (PRIOR ART)
FIG. 1 is a view illustrating a conventional pressure roller which is bent and deformed.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
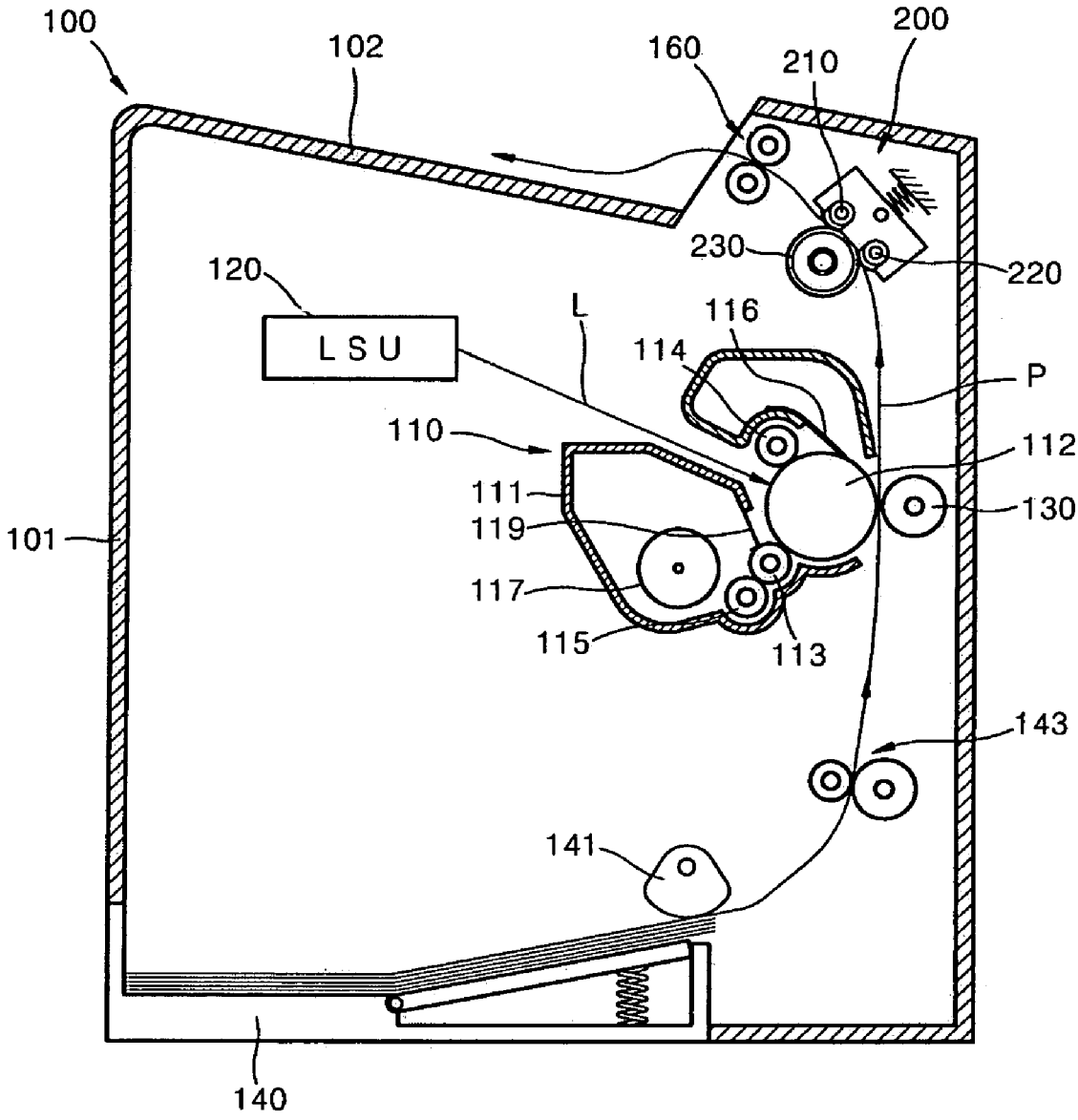
FIG. 2 illustrates a structure of an image forming apparatus according to an embodiment of the present general inventive concept.

FIG. 2 is a schematic view illustrating a structure of a fixing unit 200 and an image forming apparatus 100 having the fixing unit according to an embodiment of the present general inventive concept. Referring to FIG. 2, the image forming apparatus 100 includes a case 101 that forms an exterior of the image forming apparatus 100 and contains structural elements thereof, the fixing unit 200 disposed in the case 101 to fuse an image formed on a printing medium, and an image forming unit to form the image on the printing medium. In FIG. 2, the image forming unit includes a light illuminator 120, a developer 110, and a transfer roller 130.

The light illuminator 120 (e.g., a laser scanning unit (LSU), as illustrated in FIG. 2) forms a predetermined latent image while illuminating a light signal L onto a photosensitive drum 112 along scan lines. The developer 110 includes the photosensitive drum 112 on which the latent image is formed on an outer circumferential surface of the photosensitive drum 112 by the light illuminator 120, a charging roller 114 to charge the photosensitive drum 112, a developing roller 113 to supply a toner to the latent image on the photosensitive drum 112, and a waste toner cleaner 116 to remove a waste toner remaining on the photosensitive drum 112 after the toner is transferred onto the printing medium. A supply roller 115 to supply the toner contained in a housing 111 to the developing roller 113 and a doctor blade 119 to control a thickness of the toner attached on the surface of the developing roller 113 to be a predetermined thickness are disposed around the developing roller 113. Meanwhile, a stirrer 117 to stir the toner to prevent the toner from hardening is provided on the housing 111 containing the toner.

The transfer roller 130, which comes in contact with the photosensitive drum 112 by a predetermined pressure, transfers the toner image formed on the photosensitive drum 112 to the printing medium that passes between the photosensitive drum 112 and the transfer roller 130. In FIG. 2, the reference numeral P refers to a transferring path of the printing medium. The printing medium is stored in a paper loading cassette 140, picked up sheet-by-sheet by a pickup roller 141, and then supplied towards the transfer roller 130 after passing through a paper aligner 143. Along with a paper loading operation, the paper aligner 143 aligns the printing medium to transfer the toner image onto a desired area on the printing medium.

When the printing medium passes between a heat roller 230 and first and second pressing rollers 210 and 220, the fixing unit 200 including the heat roller 230 and the pressing rollers 210 and 220, which closely contact the heat roller 230 and rotate in a direction opposite to a rotating direction of the heat roller 230, allows the toner image to be thermally fused by a predetermined heat and pressure. In this manner, the printing medium having the fixed image is moved out from the case 101 by a pair of paper rollers 160, and the printing medium is then accumulated on a paper-out tray 102.

Figure 3:
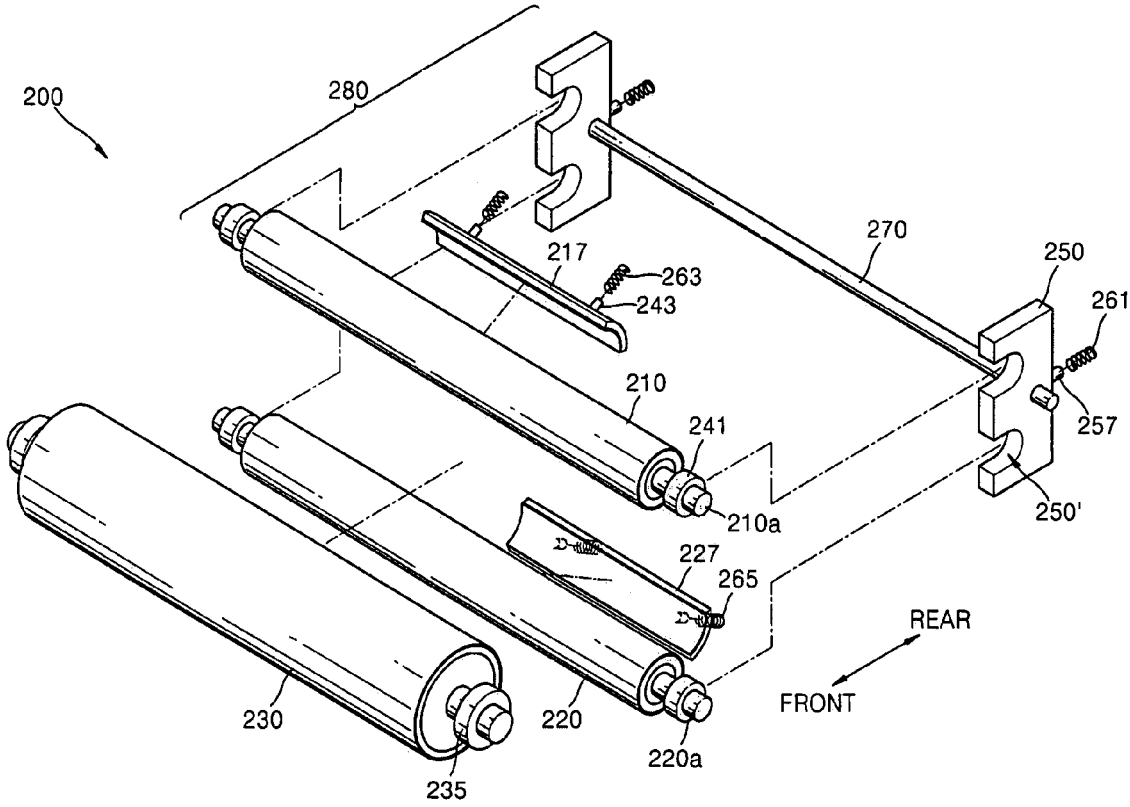
FIG. 3 is an exploded perspective view illustrating a fixing unit of the image forming apparatus of FIG. 2 according to an embodiment of the present general inventive concept.

FIG. 3 is an exploded perspective view illustrating the fixing unit 200 of the image forming apparatus 100 of FIG. 2 according to an embodiment of the present general inventive concept. The fixing unit 200 in this embodiment includes the heat roller 230 and a pressing roller assembly 280, facing each other. The pressing roller assembly 280 includes the first and second pressing rollers 210 and 220, to closely contact the heat roller 230, and a bushing 250 to support the pressing rollers 210 and 220.

The heat roller 230 is rotatably supported in the case 101 (see FIG. 1) by a bearing 235 provided at both ends thereof, and a gear (not illustrated) that serves as a power transfer member is provided on at least one end of the heat roller 230. The heat roller 230 is driven at a constant rotation speed by the power transfer member. As the heat roller 230 rotates, the pressing rollers 210 and 220 contacting the heat roller 230 also rotate due to the rotation of the heat roller 230. The fixing unit 200 of the present general inventive concept can include more than two pressing rollers in contact with the outer circumferential surface of the heat roller, although only the two pressing rollers 210 and 220 are provided in the fixing unit 200 of the embodiment illustrated in FIG. 2. Furthermore, the fixing unit 200 of the present general inventive concept can include only a single pressing roller in contact with the outer circumferential surface of the heat roller. In addition, although the power transfer member is described above as being provided on the heat roller 230, the power transfer member can instead be provided on the first pressing roller 210 and/or the second pressing roller 220.

The pressing rollers 210 and 220 fit into the bushing 250 at shafts 210*a* and 220*a*, respectively, at both ends thereof, and are rotatably supported by the bushing 250. The bushing 250 is provided in pair to support both ends of each of the pressing rollers 210 and 220, and the pair of bushings 250 face each other and are supported by a connecting member 270 extending parallel to the pressing rollers 210 and 220. A boss 257, in which an elastic body 261 is fixedly inserted, protrudes from a rear side of each of the bushings 250, and the pressing rollers 210 and 220 are elastically pressed towards the heat roller 230 by the elastic body 261. Placement notches 250', in which the shafts 210*a* and 220*a* of the pressing rollers 210 and 220 are inserted, are formed on the bushing 250 to support the pressing rollers 210 and 220 together, and the placement notches 250' are formed to be hollowed from a front side of the bushing 250 to the rear side thereof to a predetermined depth, being separated from each other by a predetermined distance. A journal bearing 241 to support the rotation of the first and second pressing rollers 210 and 220 is placed on the shafts 210*a* and 220*a*. Although FIG. 3 illustrates the pair of bushings 250 and the connecting member 270 as being separate structures, the bushings 250 and the connecting member 270 can be formed as a single, monolithic structure.

At a center portion of the pressing rollers 210 and 220 in a longitudinal direction, backup members 217 and 227, which respectively contact the first and second pressing rollers 210 and 220 and apply a predetermined pressure to the first and second pressing rollers 210 and 220, respectively, are disposed to cover a portion of the outer circumference of the first and second pressing rollers 210 and 220. Furthermore, a boss 243, in which backup elastic bodies 263 and 265 are inserted, is formed on each of the backup members 217 and 227 to protrude from a side of the backup members 217 and 227 that does not face the first and second pressing rollers 210 and 220, respectively. The pressing rollers 210 and 220 are pressed towards the heat roller 230 by the bushing 250 closely contacting both ends of each of the first and second pressing rollers 210 and 220, and the center portions of each of the first and second pressing rollers 210 and 220 are locally pressed towards the heat roller 230 by the backup members 217 and 227, respectively.

Figure 4:
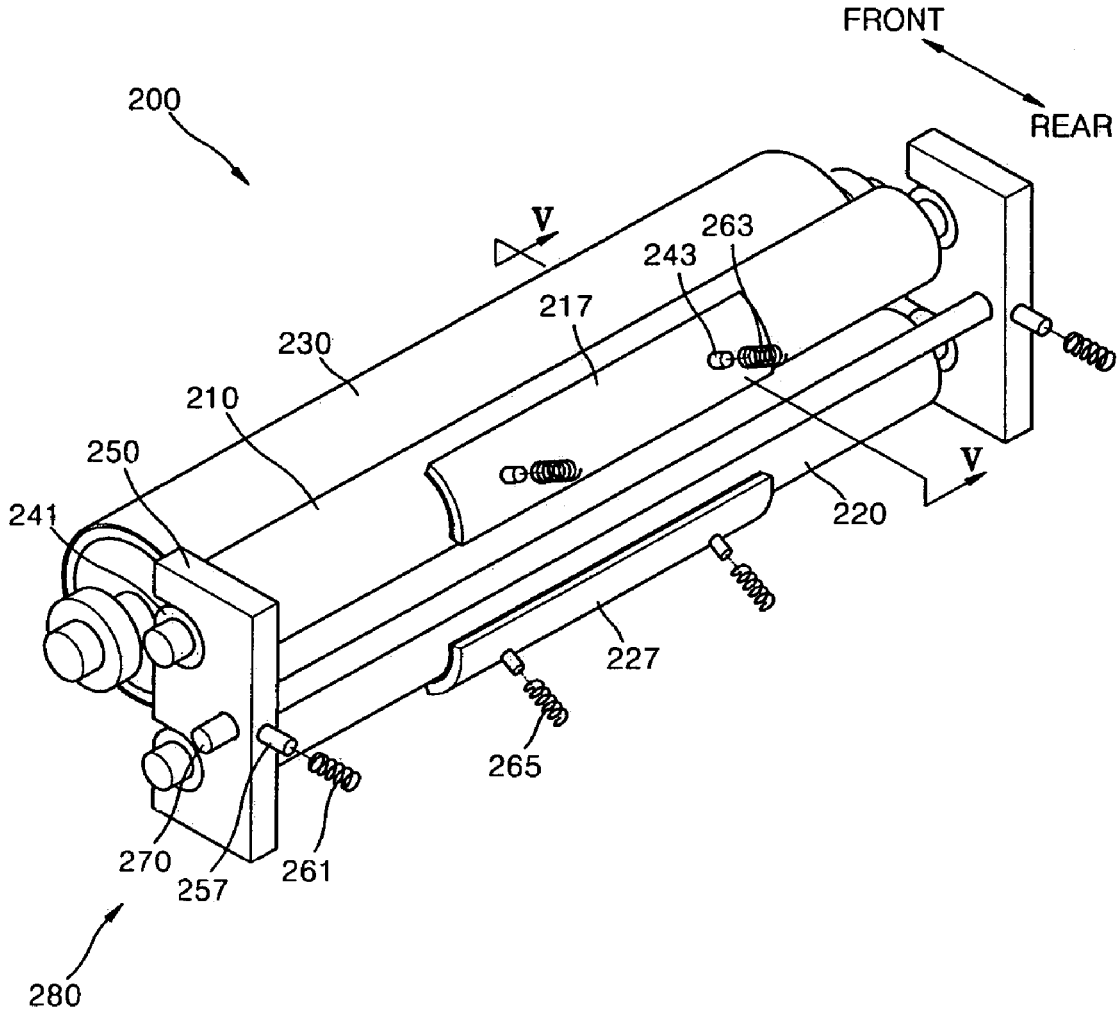
FIG. 4 is a perspective rear view illustrating the fixing unit of FIG. 3.

FIG. 4 is a perspective rear view illustrating the fixing unit 200 of FIG. 3. Referring to FIG. 4, the pressing rollers 210 and 220 are rotatably supported by the bushings 250, and the pair of bushings 250, facing each other, are coupled each other by the connecting member 270 that pierces the bushings 250 and extends parallel to the pressing rollers 210 and 220. An end of the connecting member 270 can protrude outwardly, piercing the bushing 250, can be hinged by a fastening member (not illustrated) provided on the case 101, and thereby can be a center of rotation of the pressing roller assembly 280. The boss 257 protrudes from the rear side of the bushing 250, and the elastic body 261 is fixedly inserted therein. The elastic body 261 is provided between an inward wall (not illustrated) of the case 101 and the bushing 250 and presses the busing 250 towards the heat roller 230 located closer to a front side of the case 101. Accordingly, the pressing rollers 210 and 220 placed into the bushing 250 are pressed towards the heat roller 230. Pressure applied to and divided between the pressing rollers 210 and 220 changes significantly according to a position of the boss 257, but if the boss 257 is positioned to be separated from each of the pressing rollers 210 and 220 by a substantially equal distance, the pressure applied to and divided between the pressing rollers 210 and 220 is substantially equal.

Meanwhile, at the respective center portions of the pressing rollers 210 and 220 in the longitudinal direction, the backup members 217 and 227, which elastically apply pressure to the pressing rollers 210 and 220 from the rear side thereof, face the pressing rollers 210 and 220, and come into slide-contact with the outer circumferential surfaces of the pressing rollers 210 and 220, respectively, so that the pressing rollers 210 and 220 rotate without being hindered by the backup members 217 and 227. "Slide-contact" means to contact a part without hindering a rotation of that part.

The boss 243 in which the backup elastic bodies 263 and 265 are inserted is provided on the backup members 217 and 227 to protrude from the rear sides thereof. Each of the backup members 217 and 227 presses the pressing rollers 210 and 220, respectively, towards the heat roller 230, and more specifically, towards an axis-core of the heat roller 230. Thus, being in close contact with an upper side outer circumferential surface of the first pressing roller 210, as illustrated in FIG. 4, the first backup elastic bodies 263 provide the elastic force that tends to downwardly press the first pressing roller 210. Similarly, being in close contact with a lower side outer circumferential surface of the second pressing roller 220, as illustrated in FIG. 4, the second backup elastic bodies 265 provide the elastic force that tends to upwardly lift the second pressing roller 220. This will be described in more detail below. The pressing rollers 210 and 220 of this embodiment of the present general inventive concept are pressed towards the heat roller 230 by the bushing 250 closely contacting both ends of the pressing rollers 210 and 220, and at the same time, pressed towards the heat roller 230 by the backup members 217 and 227, in contact with the center portions of the pressing rollers 210 and 220, respectively.

Figure 5:
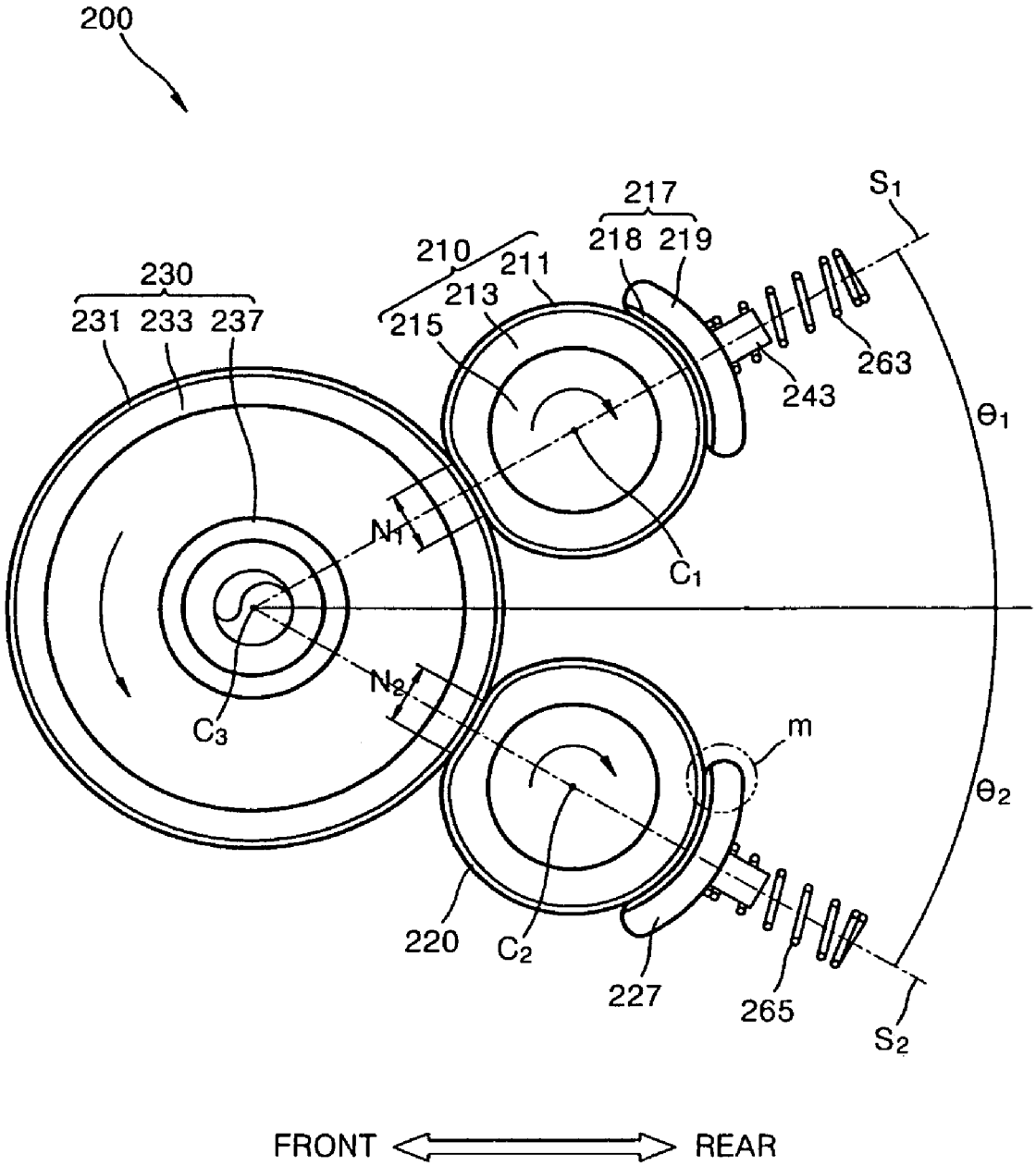
FIG. 5 is a cross-sectional view illustrating the fixing unit of FIG. 3 along the line V-V of FIG. 4.

FIG. 5 is a cross-sectional view illustrating the fixing unit 200 of FIG. 3 along the line V-V of FIG. 4. Referring to FIG. 5, the first pressing roller 210 and the second pressing rollers 220 closely contact the heat roller 230 sequentially along the outer circumference of the heat roller 230. The heat roller 230 can include a heat source 237 therein to apply heat to the printing medium on which toner particles are transferred. The heat source 237 may be, but is not limited to, a halogen lamp, a hot wire, or an induction heater. The heat roller 230 may include a pipe 233 having a cavity therein, and the outer circumferential surface can be coated with a release layer 231. The release layer 231 may be formed at the most outer surface of the heat roller 230, so that a desired separation property of toner particles can be achieved. The release layer 231 may be made of, for example, a heat-proof type wax.

One or both of the pressing rollers 210 and 220 in close contact with the heat roller 230 may include a metal drum 215 that forms a frame constructing an inner core thereof, an elastic layer 213 formed on an outer circumferential surface of the metal drum 215, and a release layer 211 coated on an outer circumferential surface of the elastic layer 213. The elastic layer 213 may be made of an elastic material, such as polyurethane or silicone. The elastic layer 213, if desired, may be formed on both of the pressing rollers 210 and 220. Alternatively, the elastic layer 213, if desired, may be formed on only one of, or on neither of, the pressing rollers 210 and 220. As the pressing rollers 210 and 220 are in close contact with the heat roller 230, first and second fixing nips N1 and N2 are formed between the two pressing rollers 210 and 220 and the heat roller 230, respectively, the elastic layers 213 of the pressing rollers 210 and 220 being compressed against the heat roller 230. While the printing medium passes the first and second fixing nips N1 and N2, the toner particles attached on the printing medium are firmly fused on the printing medium by a predetermined heat and pressure. The fixing unit 200 of this embodiment of the present general inventive concept uses the two pressing rollers 210 and 220, as illustrated in FIG. 5, to obtain the minimized fixing unit 200 and to ensure the fixing nips N1 and N2 having a sufficient length. However, in various embodiments, a single pressing roller or more than two pressing rollers can be used. The release layer 211 may be formed on the outer circumferential surface of the elastic layer 213, and the release layer 211 allows the toner particles to be readily detached from the outer circumferential surface of the release layer 211 instead of being attached thereto, similar to the release layer 231 of the heat roller 230.

Meanwhile, the backup member 217 that covers a portion of the outer circumferential surface of the pressing roller 210, being pressed to come in contact therewith, may include a release layer 218 that forms a contact surface between an arc shaped main frame 219 and the pressing roller 210. The release layer 218 allows the backup member 217 to be in slide-contact with the pressing roller 210 to prevent an unnecessary interruption when the pressing roller 210 rotates. The release layer 218 may be formed of, for example, a heat-proof wax type material, and a width of the release layer 218 may be approximately 500 μm to approximately 700 μm. For example, to the release layer 218 may be relatively thicker than the release layer 211 having a thickness of approximately 200 μm to approximately 300 μm.

The bosses 243 protrude from the rear side of each of the backup members 217 and 227, and the backup elastic bodies 263 and 265 are fixedly inserted over the bosses 243. The backup elastic bodies 263 and 265 are provided in a compressed manner between the case 101, not shown, and the backup member 217 and 227, and the backup member 217 and 227 are elastically pressed towards the heat roller 230 by an elongation of the backup elastic bodies 263 and 265. The backup elastic bodies 263 and 265 can be placed on imaginary lines S1 and S2 that reciprocally connect an axis-core C3 of the heat roller 230 and axis-cores C1 and C2, respectively, of each of the pressing rollers 210 and 220, so that the first backup elastic body 263 is slightly tilted at an angle θ1 with respect to a horizontal line extending through the axis core C3 and separating the pressing rollers 210 and 220 to provide the elastic force at the angle θ1, and the second backup elastic body 265 is slightly tilted at an angle 02 with respect to the horizontal line to provide the elastic force at the angle 02. Therefore, the backup members 217 and 227, on which the backup elastic bodies 263 and 265 are placed, are also provided to be slightly tilted by angle θ1 upwards and θ2 downwards, respectively, with respect to the horizontal line.

In the fixing unit 200 of FIG. 5, the first pressing roller 210 and the second pressing roller 220 are positioned symmetrically with respect to one another on respective sides of the horizontal line, and have the same diameter, so that the angels θ1 and θ2 formed by the axis-cores C1 and C2 with the axis-core C3 of the heat roller 230 are equal during use. However, in other embodiments, the angles θ1 and θ2 can be different. The backup elastic bodies 263 and 265 placed towards the axis-core C3 of the heat roller 230 are effective in pressing the pressing rollers 210 and 220, and the center portion of the pressing rollers 210 and 220 is locally pressed to closely contact the heat roller 230.

Meanwhile, if a sharp edge is formed on an edge portion m of the backup members 217 and 227, the pressing rollers 210 and 220 that rotate in contact therewith may be defective or operation thereof may be interfered with. To prevent this, the edge portion m of the backup member 217 can be rounded, as illustrated in FIG. 5, so that unnecessary interruption of the interaction between the pressing roller 210 and the backup member 217 is prevented.

Figure 6:
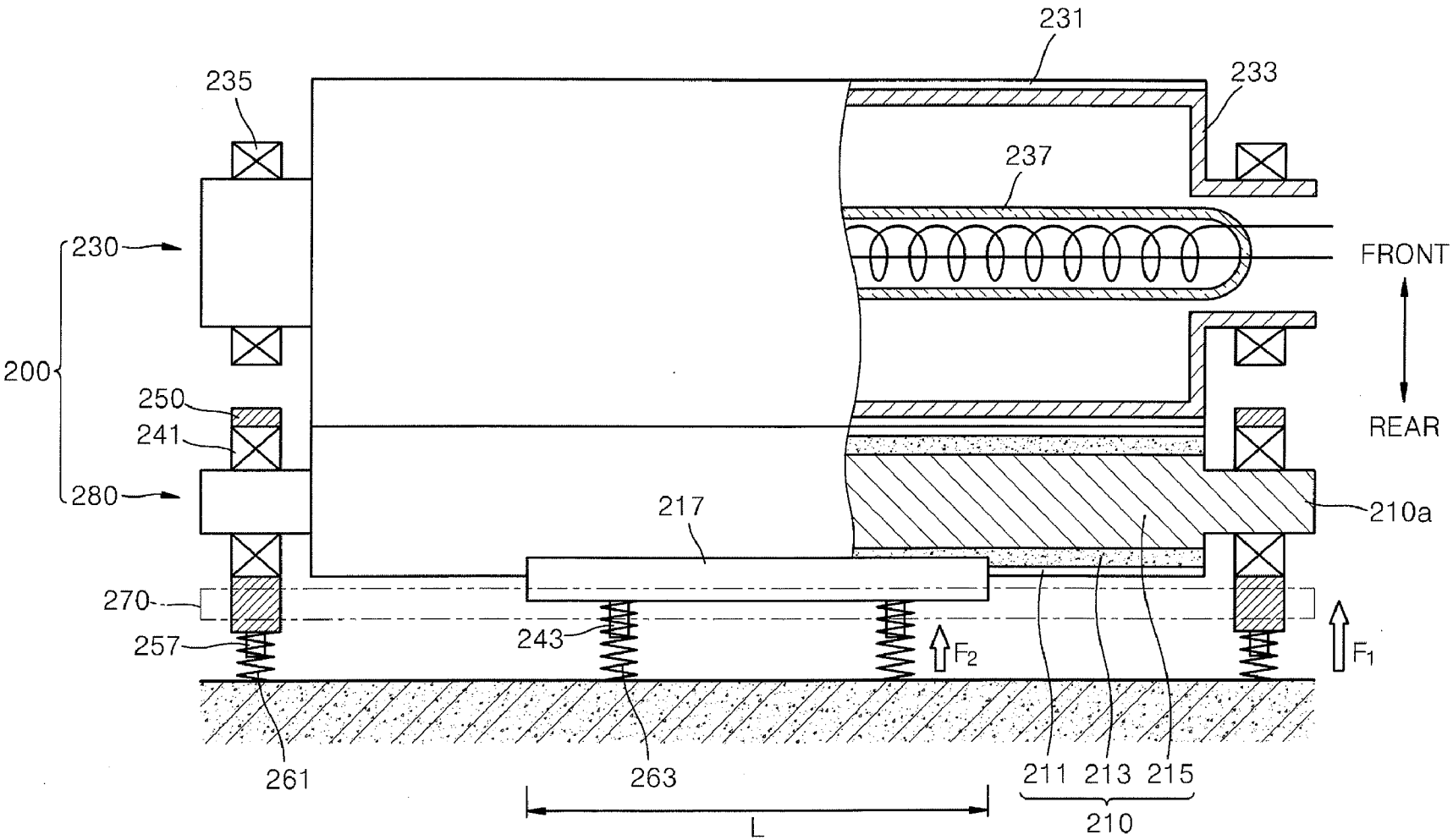
FIG. 6 is a view illustrating a support structure of the fixing unit of FIG. 3.

FIG. 6 is a schematic view illustrating a support structure of the fixing unit 200 of FIG. 3. Hereinafter, a function of the backup elastic body 263 used in various embodiments of the present general inventive concept will be described with reference to FIG. 6. Conventionally, there have been problems that the pressing roller 10 is bent and deformed by a bushing that presses both ends of the pressing roller 10, and a center portion of the pressing roller 10 forms the curve portion C due to the deformation thereof and thus cannot closely contact the heat roller sufficiently, resulting in a drop in a fixing capability (see FIG. 1). In embodiments of the present general inventive concept, the backup elastic body 263 locally applies pressure on the center portion of the pressing roller 210 by the elastic force $F_2$ of the elastic body 263, and is used along with the elastic body 261 of the bushing 250 that applies pressure on both ends of the pressing roller 210 by the elastic force $F_1$ of the elastic body 261 (see FIGS. 3 and 4), so that the pressing roller 210 is not bent, and a uniform fixing nip can thus be formed along the longitudinal direction of the pressing roller 210.

Meanwhile, a length L of the backup member 217 pressed to contact the pressing roller 210 can have a length greater than that necessary to prevent the bending deformation. The pressing roller 210 can effectively be prevented from being deformed by increasing the length L of the backup member 217; however, when the backup member 217 is elongated to a length greater than that necessary to prevent the bending deformation, the extra portions of the backup member 217 result in a waste of material, so proper control thereof is desired.

Figure 7:
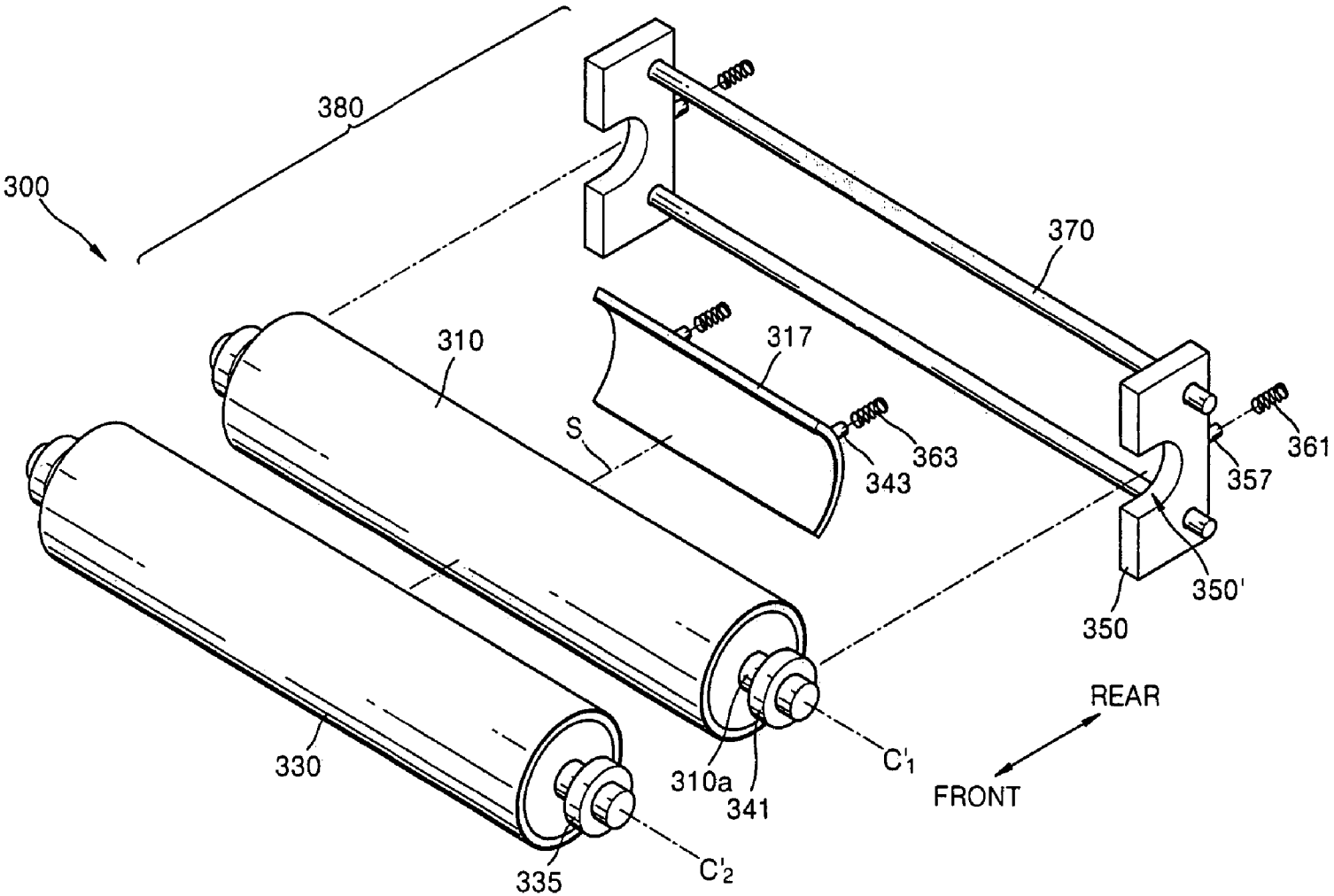
FIG. 7 is an exploded perspective view illustrating a fixing unit according to another embodiment of the present general inventive concept.

The scope of the present general inventive concept is not limited to a fixing unit having more than two pressing rollers, but also encompasses a fixing unit having a single pressing roller. For example, as illustrated in FIG. 7, one pressing roller 310 can be included in a fixing unit 300 according to embodiments of the present general inventive concept. The fixing unit 300 illustrated in FIG. 7 includes a heat roller 330 including a heat source (not illustrated), a pressing roller assembly 380 in close contact with the heat roller 330, and a bearing 335. The pressing roller assembly 380 includes a single pressing roller 310 in close contact with the heat roller 330, and a pair of bushings 350 at each end of the pressing roller 310 to press the pressing rollers 310 into close contact with the heat roller 330. A placement notch 350' is formed at the bushings 350, for example, by hollowing a front side of the bushing 350 towards a rear side of the bushing 350 to a predetermined depth. A shaft 310*a* is formed at both ends of the pressing roller 310 and is insertable into the placement notch 350'. A journal bearing 341 is insertable into the shaft 310*a* at both ends of the pressing roller 310 once placed into the placement notch 350', and the journal bearing 341 supports a rotation of the pressing roller 310, being disposed between the pressing roller 310 and the bushings 350. The pair of bushings 350 support both ends of the pressing roller 310 and are connected each other by a connecting member 370 having two portions extending parallel to the pressing roller 310 at upper and lower sides of the pressing roller 310, respectively, to support each other. Although FIG. 7 illustrates the pair of bushings 350 and the connecting member 370 as being separate structures, in embodiments, the bushings 350 and the connecting member 370 can be formed as a single, monolithic structure.

The bushings 350 are elastically biased towards the pressing roller 310 by an elastic body 361 at a rear side of the bushings 350, and a boss 357 is formed to protrude from the rear side of the bushing 350, so that the elastic body 361 can be inserted in the boss 357. A center portion of the pressing roller 310 is additionally pressed in a longitudinal direction thereof towards the heat roller 330 by a backup member 317 that covers a portion of an outer circumference of the pressing roller 310 and closely contacts the pressing roller 310. A boss 343 protrudes from a rear side of the backup member 317, and a backup elastic body 363 is fixedly inserted into the boss 343. The backup elastic body 363 can be positioned horizontally on an imaginary extended line S that connects an axis-core C'2 of the heat roller 330 and an axis-core C'1 of the pressing roller 310, and thus the center portion of the pressing roller 310 can closely contact the heat roller 330 effectively. Without the backup elastic body 363, the pressing roller 310, of which both ends are pressed by the bushing 350, may be bent and deformed, and thus the center portion thereof may be undesirably curved in the longitudinal direction. Thus, the backup elastic body 363 locally presses the center portion of the pressing roller 310 to prevent the pressing roller 310 from bending and deforming and to form a uniform fixing nip in which uniform pressure and heat are applied along the longitudinal direction thereof.

Figure 8:
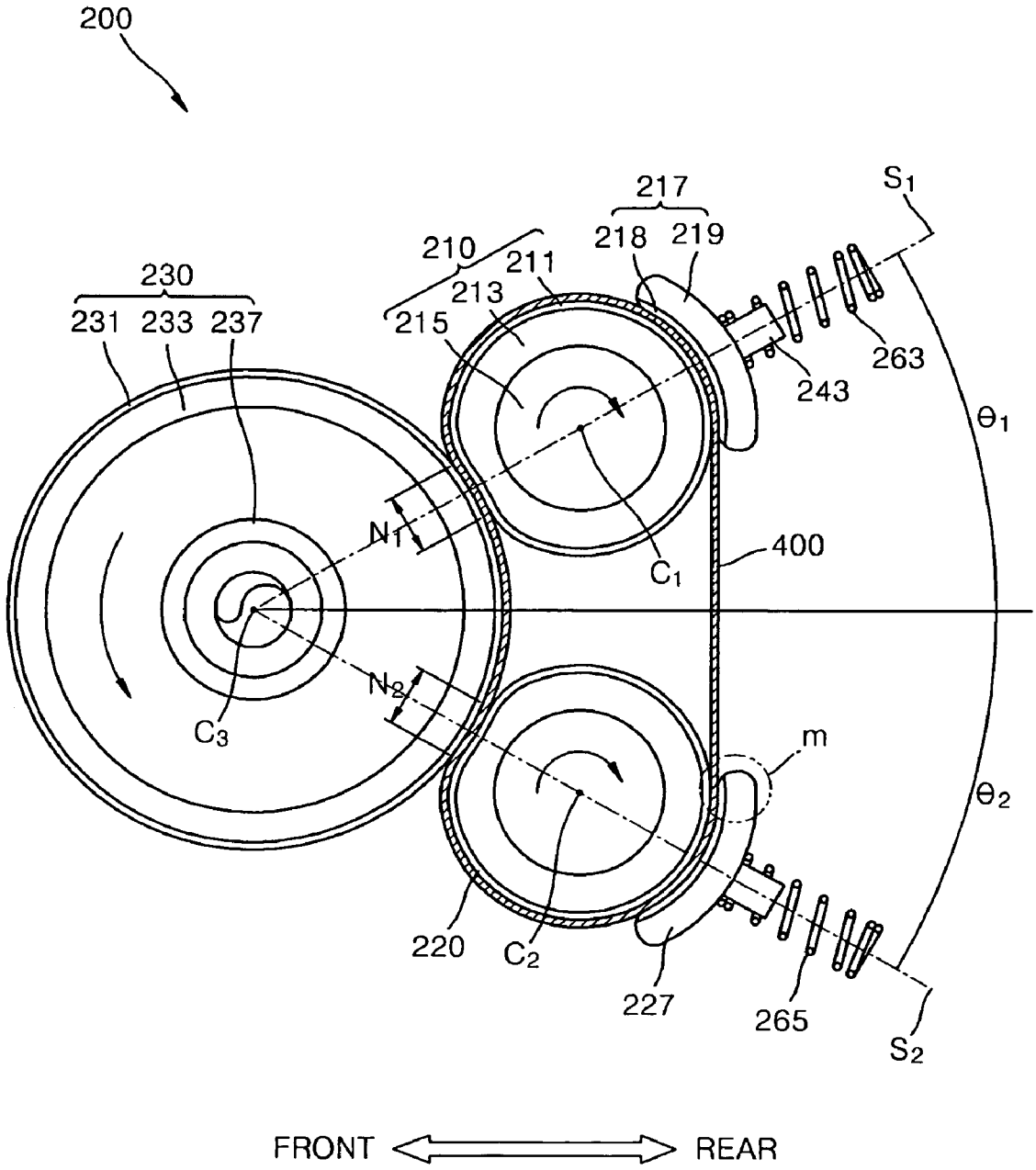
FIG. 8 is a cross-sectional view illustrating a fixing unit including a belt according to an embodiment of the present general inventive concept.

FIG. 8 is a cross-sectional view illustrating a fixing unit 200 including a belt 400, according to an embodiment of the present general inventive concept. The fixing unit 200 is useable in an image forming apparatus and includes a heating unit, a pressure unit, and a belt 400 to convey a printing medium containing an image through the fixing unit 200. The pressure unit presses the belt 400 toward the heating unit. The heating unit may include a heat roller 230. The pressure unit may include a first pressing roller 210, a first back-up member 217, a second pressing roller 220, a second back-up member 227, and a support unit, such as a pressure roller assembly 280 (see FIG. 4) or 380 (see FIG. 7).

The first pressing roller 210 presses a first portion of the belt 400 towards a first portion of the heating roller 230 to form a first fixing area N1 between the first pressing roller 210 and the heating roller 230. The first back-up member 217 provides a first elastic force to the first pressing roller 210 towards the belt 400. The second pressing roller 220 presses a second portion of the belt 400 towards a second portion of the heating roller 230 to form a second fixing area N2 between the second pressing roller 220 and the heating roller 230. The second back-up member 227 provides a second elastic force to the second pressing roller 220 towards the heating roller 230. The support unit rotatably supports the first and second pressing rollers 210 and 220 to provide third and fourth elastic forces to the first and second pressing rollers 210 and 220, respectively, towards the heating roller 230.

According to the present general inventive concept, in a fixing unit and an image forming apparatus having the fixing unit, a pressing roller that forms a fixing nip is prevented from being bent and deformed, and a fixing nip is formed in a uniform condition along a longitudinal direction of the pressing roller, so that problems of poor printing quality and/or a lifespan reduction can be avoided. In addition, a structure to prevent pressing rollers from being deformed can be used with pressing rollers having relatively smaller diameters, thereby obtaining an effectively minimized fixing unit size and ensuring a fixing nip having a sufficient length.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fixing unit to thermally fuse a toner image onto a printing medium by applying heat and pressure to the printing medium having the toner image, the fixing unit comprising:

a heat roller including a heat source;

a plurality of pressing rollers in contact with the heat roller;

a first elastic body to elastically apply pressure to first ends of each of the plurality of pressing rollers towards the heat roller and a second elastic body to elastically apply pressure to second ends of each of the plurality of pressing rollers towards the heat roller;

a plurality of backup members disposed such that a respective one of the plurality of backup members is in close contact with a central portion of a corresponding one of the plurality of pressing rollers to locally press the central portion of the corresponding pressing roller towards the heat roller; and at least one backup elastic body to elastically press a corresponding one of the plurality of backup members towards the heat roller.

2. The fixing unit according to claim 1, wherein the plurality of pressing rollers comprises:

a plurality of pressing rollers in close contact with the heat roller sequentially along an outer circumference of the heat roller.

3. The fixing unit according to claim 1, wherein each of the plurality of backup members has an arc shaped section to cover at least a portion of an outer circumferential surface of the corresponding pressing roller.

4. The fixing unit according to claim 1, wherein the each of the at least one backup elastic body is located along a corresponding straight line that connects an axis-core of the heat roller and an axis-core of a corresponding pressing roller to each other to provide an elastic force along the corresponding straight line towards the heat roller.

5. The fixing unit according to claim 1, wherein each of the plurality of backup members comprises:

a boss protruding from a first side of each of the plurality of backup members opposite to a second side of each of the plurality of backup members which is in contact with the corresponding pressing roller and on which the corresponding backup elastic body is fixedly inserted.

6. The fixing unit according to claim 1, wherein each of the plurality of backup members comprises:

a release layer in slide-contact with the corresponding pressing roller.

7. The fixing unit according to claim 1, wherein at least one surface of each of the plurality of backup members in close contact with the corresponding pressing roller is rounded.

8. The fixing unit according to claim 1, further comprising:

a bushing device to rotatably support the ends of the plurality of pressing rollers and to press each of the plurality of pressing rollers towards the heat roller; and a boss protruding from a side of the bushing device opposite each of the plurality of pressing rollers, and on which an elastic body is fixedly disposed.

9. The fixing unit according to claim 8, wherein the bushing device comprises:

a pair of bushings corresponding to respective ends of each of the plurality of pressing rollers, each bushing having a boss protruding from a side thereof opposite the plurality of pressing rollers on which an elastic body is fixedly disposed; and a connecting member separating the pair of bushings from each other and to support the pair of bushings.

10. An image forming apparatus, comprising:

an image forming unit to transfer a toner image onto a printing medium; and a fixing unit to thermally fix the transferred toner image onto the printing medium, the fixing unit comprising:

a heat roller including a heat source;

a plurality of pressing rollers in close contact with the heat roller;

a first elastic body to elastically apply pressure to first ends of each of the plurality of pressing rollers towards the heat roller and a second elastic body to elastically apply pressure to second ends of each of the plurality of pressing rollers towards the heat roller;

a corresponding backup member in close contact with a central portion of each of the plurality of pressing rollers to locally press the central portion thereof towards the heat roller; and a corresponding backup elastic body to elastically press a corresponding backup member towards the heat roller.

11. The image forming apparatus according to claim 10, wherein each of the plurality of pressing rollers is in close contact with the heat roller sequentially along an outer circumference of the heat roller.

12. The image forming apparatus according to claim 10, wherein each corresponding backup member has an arc shaped section to cover at least a portion of an outer circumferential surface of the corresponding pressing roller.

13. The image forming apparatus according to claim 10, wherein the corresponding backup elastic body is located along a straight line that connects an axis-core of the heat roller and an axis-core of the corresponding pressing roller to each other to provide an elastic force along the corresponding straight line towards the heat roller.

14. The image forming apparatus according to claim 10, wherein the corresponding backup member comprises:

a boss protruding from a first side of the backup member opposite to a second side of the backup member in contact with the corresponding pressing roller, and on which the backup elastic body is fixedly disposed.

15. The image forming apparatus according to claim 10, wherein the corresponding backup member comprises:

a release layer in slide-contact with the corresponding pressing roller.

16. The image forming apparatus according to claim 10, wherein at least one surface of the corresponding backup member at least partially covers the corresponding pressing roller and is rounded.

17. The image forming apparatus according to claim 10, further comprising:

a bushing device to rotatably support ends of each of the plurality of pressing rollers and to press each of the plurality of pressing rollers towards the heat roller; and a boss protruding from a side of the bushing device opposite to the corresponding one of the plurality of pressing rollers, and on which an elastic body is fixedly disposed.

18. The image forming apparatus according to claim 17, further comprising:

a pair of bushings corresponding to respective ends of each of the plurality of pressing rollers, each bushing having a boss protruding from a side thereof opposite to the corresponding one of the plurality of pressing rollers on which an elastic body is fixedly disposed; and a connecting member separating the pair of bushings from each other to support the pair of bushings.

19. A pressure unit useable in a fixing device of an image forming apparatus, the pressure unit comprising:

a plurality of pressure rollers to apply pressure to a printing sheet having an image to be fixed;

a support unit to rotatably support the plurality of pressure rollers and to provide a first elastic force to the plurality of pressure rollers; and a separate pressure member corresponding to each of the plurality of pressure rollers and extending along a longitudinal direction of the corresponding pressure roller and in contact therewith to provide a second elastic force to the corresponding pressure roller.

20. The pressure unit according to claim 19, wherein:

the support unit provides the first elastic force to first and second ends of each of the plurality of pressure rollers; and each separate pressure member provides the second elastic force to a center portion of the corresponding pressure roller.

21. The pressure unit according to claim 19, wherein the support unit comprises:

a first bushing to rotatably support a first end of each of the plurality of pressure rollers and is elastically biased towards the plurality of pressure rollers;

a second bushing to rotatably support a second end of each of the plurality of pressure rollers and is elastically biased towards the plurality of pressure rollers; and a connecting member to connect the first and second bushings to each other.

22. A fixing unit useable in an image forming apparatus, comprising:

a belt to convey a printing medium containing an image through the fixing unit;

a heating unit on a first side of the belt to provide heat to the printing medium to fix the image; and a pressure unit to press the belt toward the heating unit, the pressing unit comprising:

a first pressure roller to press a first portion of the belt towards a first portion of the heating unit to form a first fixing area between the first pressure roller and the heating unit;

a first pressure member to provide a first elastic force to the first pressure roller towards the belt;

a second pressure roller to press a second portion of the belt towards a second portion of the heating unit to form a second fixing area between the second pressure roller and the heating unit;

a second pressure member to provide a second elastic force to the second pressure roller towards the heating unit; and a support unit to rotatably support the first and second pressure rollers and to provide third and fourth elastic forces to the first and second pressure rollers, respectively, towards the heating unit wherein an angle $\theta 1$ is formed between a horizontal line extending through a center axis of the heating unit, and a straight line extending through the center axis of the heating unit and through a center axis of the first pressure roller and through a center of the first pressure member, and wherein an angle $\theta 2$ is formed between the horizontal line extending through the center axis of the heating unit, and a straight line extending through the center axis of the heating unit and through a center axis of the second pressure roller and through a center of the second pressure member.

23. The fixing unit according to claim 22, wherein a length of the first fixing area is substantially equal to a length of the second fixing area.

* * * * *